US005827086A

United States Patent [19]

Fukuda

[11] Patent Number: 5,827,086

[45] Date of Patent: Oct. 27, 1998

[54] HALF-FITTING PREVENTION CONNECTOR

[75] Inventor: Masaru Fukuda, Shizuoka, Japan

[73] Assignee: Yazaki Corporation, Tokyo, Japan

[21] Appl. No.: 795,785

[22] Filed: Feb. 5, 1997

[30] Foreign Application Priority Data

Feb. 8, 1996 [JP] Japan ..... 8-022653

[51] Int. Cl.[6] ..... H01R 13/627

[52] U.S. Cl. ..... 439/357

[58] Field of Search ..... 439/350–358, 439/345

[56] References Cited

U.S. PATENT DOCUMENTS

| | | | |
|---|---|---|---|
| 4,548,455 | 10/1985 | Ezure | 439/352 |
| 5,082,455 | 1/1992 | Wei | 439/352 |
| 5,199,897 | 4/1993 | Hashiguchi | 439/357 |
| 5,338,227 | 8/1994 | Nakamura | 439/352 |
| 5,376,014 | 12/1994 | Sumida | 439/352 |

FOREIGN PATENT DOCUMENTS 57-10462 3/1982 Japan .

5-81967 11/1993 Japan .

*Primary Examiner*—Hien Vu

*Attorney, Agent, or Firm*—Sughrue, Mion, Zinn, Macpeak & Seas, PLLC

[57] ABSTRACT

In a half-fitting prevention connector, a cover is slidably fitted on a housing, and covers entire housing except a fitting side thereof. Cover lock release ribs are formed on an inner surface of the cover, and abut against lock release projections in accordance with the fitting of the connector relative to a mating connector. Retaining grooves for retaining engagement with the mating connector are formed on the inner surface of a front end portion of the cover. A lock arm, serving as a lock member when fitting the connector, is formed integrally on a partition wall, and is pivotally movable. The lock arm includes a support portion serving as a fulcrum for the pivotal movement, and a retaining portion for retaining engagement with the mating connector, the lock release projections formed respectively on opposite sides thereof, and a press portion at a rear end thereof, the press portion being operated when releasing a locked condition.

7 Claims, 11 Drawing Sheets

HALF-FITTING PREVENTION CONNECTOR

BACKGROUND OF THE INVENTION

The present invention relates to a half-fitting prevention connector in which a condition of half-fitting between a pair of male and female connectors to be fitted together is prevented by resiliency of a resilient member mounted in a housing of at least one of the two connectors, and the connector can be easily fitted relative to the mating connector.

Many electronic devices for various controls are mounted on modern automobiles, and naturally many wire harnesses and flat cables are used. Automobiles are exposed to severe conditions in which the automobile is subjected to vibration and submerging. Therefore, in view of an assembling process and the maintenance, half-fitting prevention connectors with a waterproof function have been used to easily connect and disconnect wires such as wire harnesses.

One conventional half-fitting connector will now be described with reference to FIGS. 10 and 11. A pin-type connector 50 has a plurality of pin contacts 52 arranged therein, and has a pair of mounting flanges 50*a* formed respectively at opposite sides thereof. A socket-type connector 51 has a plurality of socket contacts 53 arranged therein, and wires 53*a* are connected to the socket contacts 53, respectively.

The pin-type connector 50 includes a box-shaped housing 54 having an open front side, and a guide plate 55 for guiding the fitting of the socket-type connector 51 is mounted centrally of the height within the housing 54, and divides the interior of the housing 54 into an upper portion and a lower portion. As shown in FIG. 11, within the housing 54, the pin contacts 52 extend from a rear portion toward the front side of this housing. A notch is formed in a central portion of a top plate 54*b* of the housing 54, and a forwardly-directed engagement piece portion 56 is formed integrally with the top plate 54, and is disposed in this notch. A distal end of the engagement piece portion 56 terminates short of the front edge of the top plate 54*b*, and can be slightly flexed outwardly. An inwardly-directed engagement projection 56*a* is formed on the distal end of the engagement piece portion 56.

The socket-type connector 51 includes a box-shaped housing 57, and has such a size as to be fitted into the opening in the housing 54 of the pin-type connector 50. Pin holes 58 for respectively receiving the pin contacts 52, and a slot 59 for receiving the guide plate 55 are provided in the front side of the housing 57.

A movable cover 60 is fitted on the housing 57 for movement back and forth, and covers the housing 57 except front and rear end portions thereof. An opening 61 for receiving the pin-type connector 50 is formed in the front side of the movable cover 60. The opening 61 has such a size as to receive opposite side plates 54*a*, the top plate 54*b* and a bottom plate 54*c* of the housing 54.

A pair of spring receiving portions (not shown) are formed respectively at opposite side portions of the movable cover 60 and hence at opposite side portions of the housing 57, springs 64 are received respectively in the spring receiving portions as indicated by broken lines in FIG. 10, each of the springs 64 extending in the forward-backward direction. The movable cover 60 is normally urged forward (that is, left in FIG. 10) by the springs 64, and is retained by slots 65, formed through an upper wall of the movable cover 60, and projections 66 formed on the upper surface of the housing 57. An engagement groove 67 is formed in the upper surface of the housing 57, and the engagement projection 56*a* is engaged in the engagement groove 67 when the two connectors are completely connected together. The engagement groove 67 is normally concealed by the movable cover 60, and appears when the movable cover 60 is moved.

When the two connectors 50 and 51 are fitted together, the pin contacts 52 contact the socket contacts 53, respectively, and the engagement projection 56*a* is engaged in the engagement groove 67, as shown in FIG. 11. In this fitted condition, the springs 64 are compressed, and the engagement piece portion 56 is covered by the movable cover 60, so that the engagement projection 56*a* can not be disengaged from the engagement groove 67, thereby positively maintaining the connected condition.

On the other hand, when the completely-fitted condition is not achieved, that is, a half-fitted condition is encountered, the distal end of the engagement piece portion 56 abuts against the edge of the opening in the movable cover 60, and the springs 64 are compressed. Therefore, the movable cover 60 presses the engagement piece portion 56 under the influence of the springs 64, and therefore the two connectors 50 and 51 are urged away from each other, and can not be fitted together at all.

In above connector, the half-fitting can be prevented. However, when the two connectors are to be fitted together while holding the opposite side surfaces of the movable cover 60 with an operator's hand, the movable cover 60 fails to be moved, so that the fitting operation can not be achieved. Thus, there is encountered a problem that a force, applied for fitting purposes, is not efficiently used, and therefore the efficiency of the operation is low.

In addition, in the completely-fitted condition, the engagement piece portion 56 is not covered by the housing 57, and therefore when an external force acts on the movable cover 60, the movable cover 60 can be easily moved, so that the fitted condition of the connectors can be accidentally released.

SUMMARY OF THE INVENTION

It is an object of this invention to provide a half-fitting prevention connector which can be positively and easily fitted relative to a mating connector, and is positively prevented from a half-fitted condition.

The above object has been achieved by a half-fitting prevention connector described in the following paragraphs (1) to (4):

(1) A half-fitting prevention connector wherein a half-fitted condition is prevented by resiliency of a resilient member mounted in a housing of at least one of a pair of female and male connectors to be fitted and connected together, The housing has a lock member for retaining engagement with a retaining projection formed on the mating connector, the lock member is pivotally moved with the fitting of the connector relative to the mating connector, and has lock release projections formed respectively on opposite sides of the lock member. A cover member is slidably fitted on the housing, and covers the housing over an entire periphery thereof. The cover member has cover lock release ribs formed on an inner surface thereof, and the cover lock release ribs abut respectively against the lock release projections in accordance with the fitting of the connector relative to the mating connector.

(2) In the half-fitting prevention connector described in paragraph (1), the lock member is integrally formed through a support portion on a partition wall receiving connection terminals therein, and is pivotally movable about the support portion, and the lock member has at its front end a retaining portion for retaining engagement with the retaining projection, and also has at its rear end a press portion which is pressed when releasing a locked condition.

(3) In the half-fitting prevention connector described in paragraph (1), the cover member has a fitting release door mounted by a hinge portion for being opened and closed. A retaining groove for retaining engagement with a retaining rib formed on the mating connector is formed on the inner surface of the front end portion of the cover member.

(4) In the half-fitting prevention connector described in paragraph (1), a release portion is formed at a front end of each of the cover lock release ribs, and has a forwardly-slanting surface, and the release portion pushes the associated lock release projection upward in accordance with the fitting of the connector relative to the mating connector.

When fitting the half-fitting prevention connector of the above construction relative to the mating connector, with the cover member (slidably fitted on the housing over the entire periphery thereof) held with the hand, the retaining portion at the front end of the lock member on the housing is brought into abutment against the retaining projection formed on the insertion frame-of the mating connector.

Then, only the cover member, which is slidable relative to the housing, is moved toward the mating connector against the bias or resiliency of the resilient member, so that the release portions, formed respectively at the front ends of the cover lock release ribs formed on the inner surface of the cover member, push the lock release projections of the lock member upward, respectively. As a result, the front portion of the lock member is pivotally moved upward about the support portion, and when the lock member slides over the retaining projection of the mating connector, the whole of the housing is moved toward the mating connector by the resiliency of the resilient member.

Then, when the cover member is further pushed toward the mating connector, the retaining grooves are retainingly engaged with the retaining ribs of the mating connector, respectively, and the retaining portion of the lock member is retained by the retaining projection of the mating connector, thus completing the operation of fitting of the connector on the mating connector.

Therefore, if the fitting operation is stopped before the retaining portion slides over the retaining projection, the cover member is urged or returned in the anti-fitting direction by the bias or resiliency of the resilient member, so that the cover member is disengaged, or the rear end portion of the housing is projected from the rear end of the cover member. From this, the half-fitted condition can be easily detected. Therefore, the operation of fitting of the connector relative to the mating connector can be effected positively and easily, and the efficiency of the operation can be enhanced, and the half-fitted condition can be positively prevented from being maintained.

For releasing the fitted condition, the fitting release door, provided on the cover member covering the housing, is opened, and then the lock member is pressed to be pivotally moved, so that the lock member can be easily brought out of retaining engagement with the retaining projection of the mating connector.

Since the whole of the housing except its fitting side is covered with the cover member, the housing can be positively protected from an external force, and also the waterproof effect is enhanced.

BRIEF DESCRIPTION OF THE DRAWINGS

FIG. 4(*b*) is a front-elevational view showing the construction of the mating connector;

DETAILED DESCRIPTION OF THE INVENTION

Figure 1:
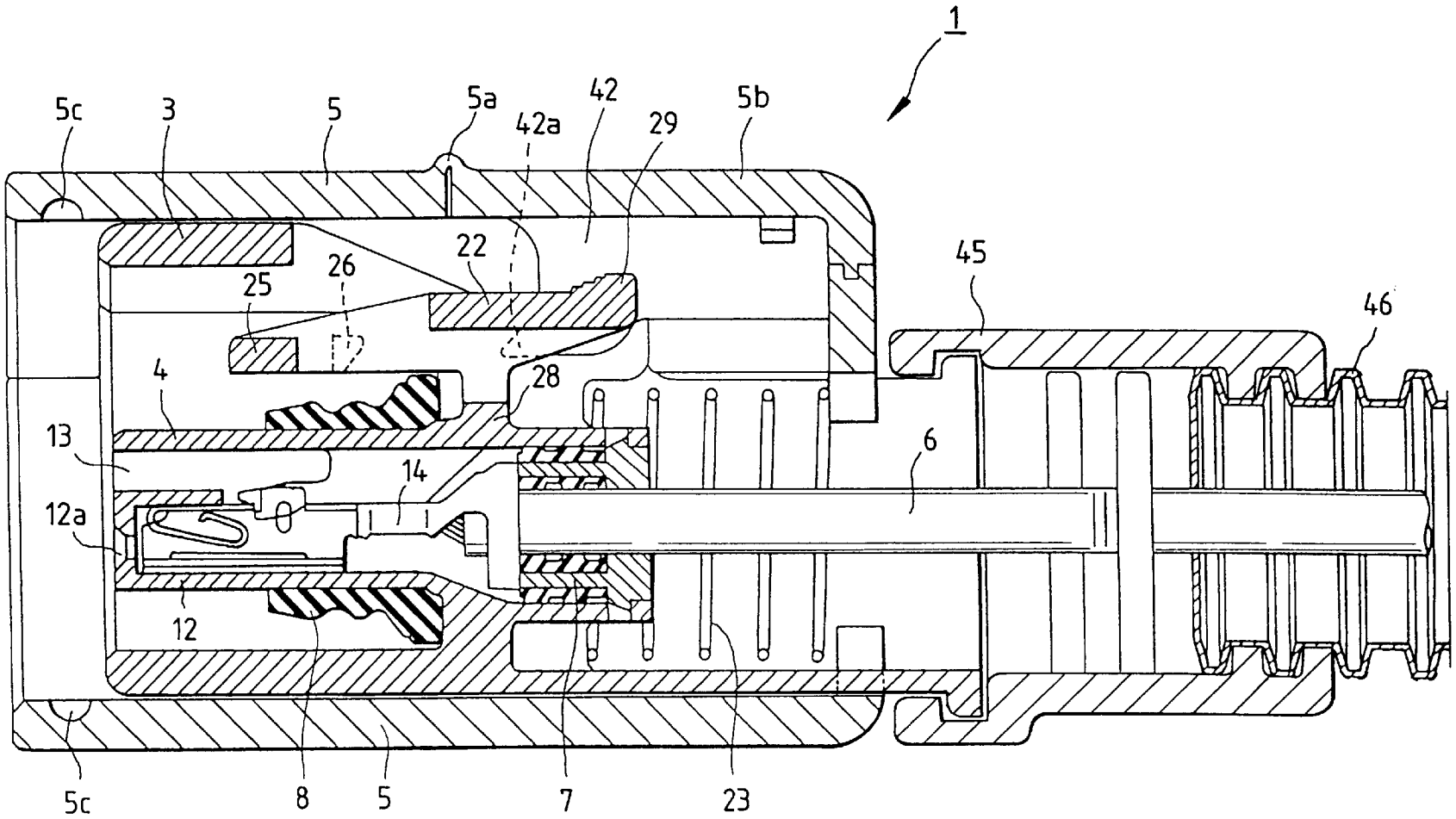
FIG. 1 a vertical cross-sectional view showing a preferred embodiment of a half-fitting prevention connector of the present invention.
Figure 2:
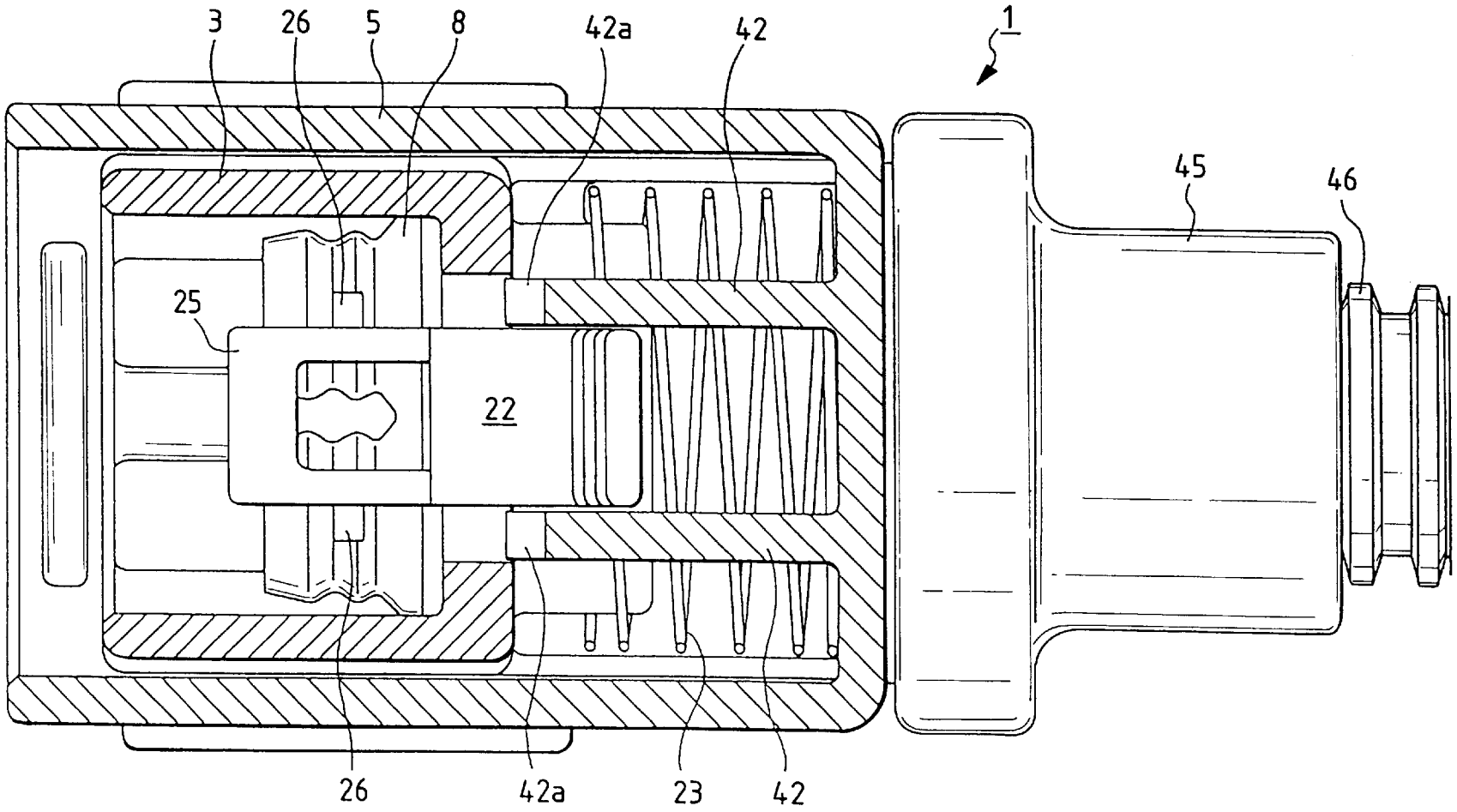
FIG. 2 is a horizontal cross-sectional view showing the construction of the half-fitting prevention connector of FIG. 1.
Figure 3:
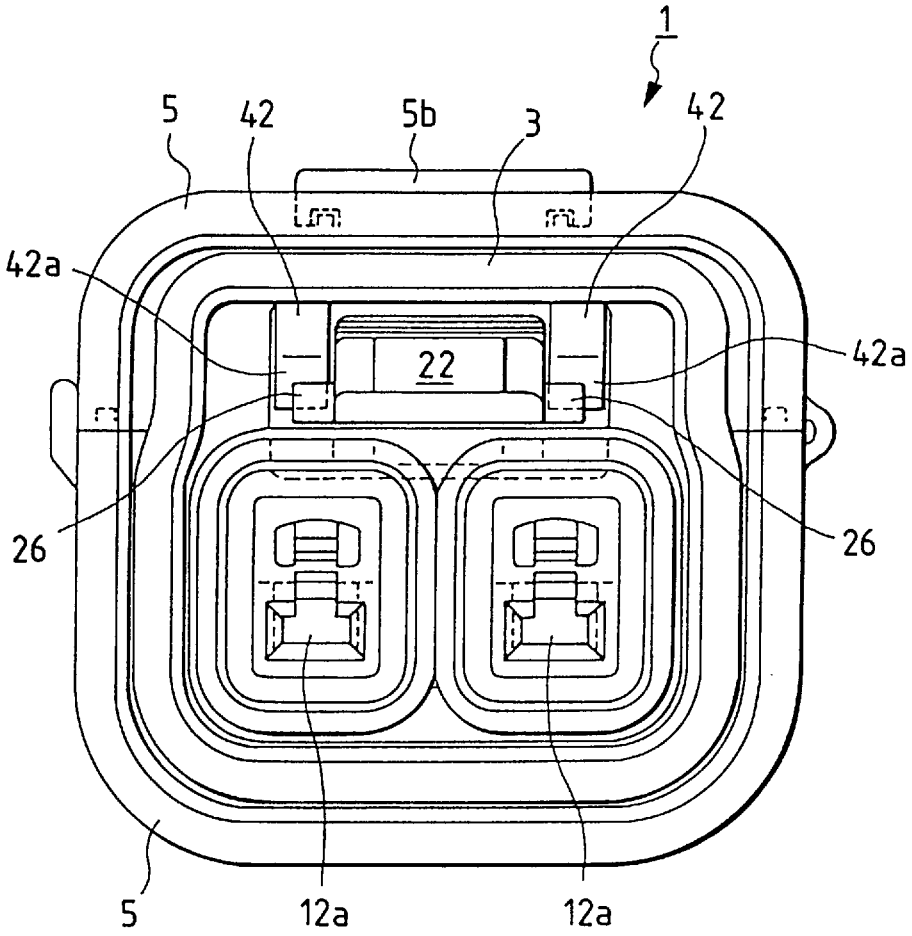
FIG. 3 is a front-elevational view showing the construction of the half-fitting prevention connector of FIG. 1.
Figure 4B:
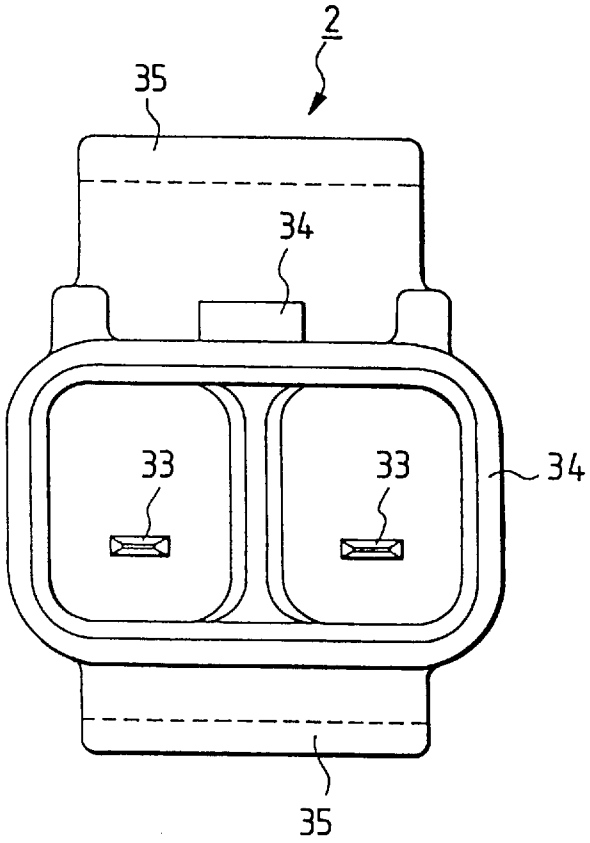
FIG. 4(*a*) a vertical cross-sectional view showing the construction a mating connector.
Figure 4A:
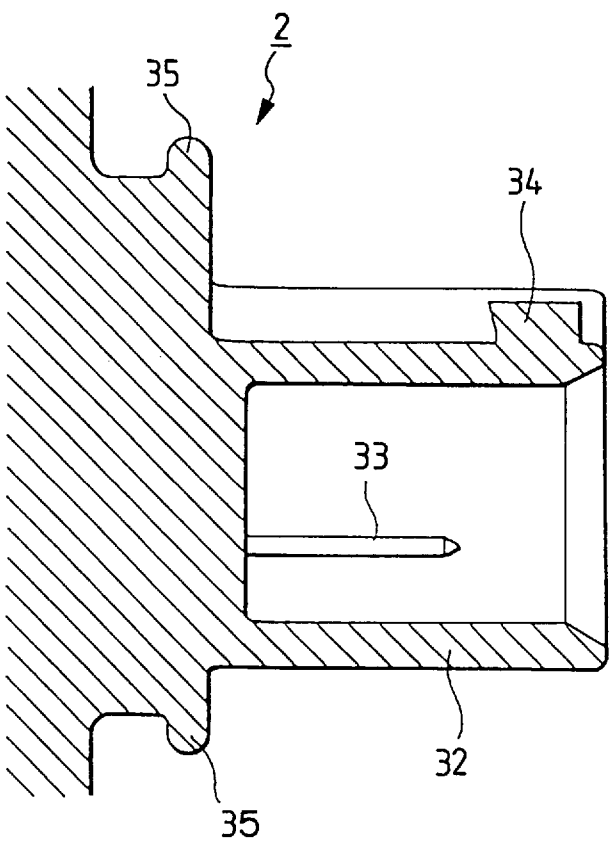
Figure 5:
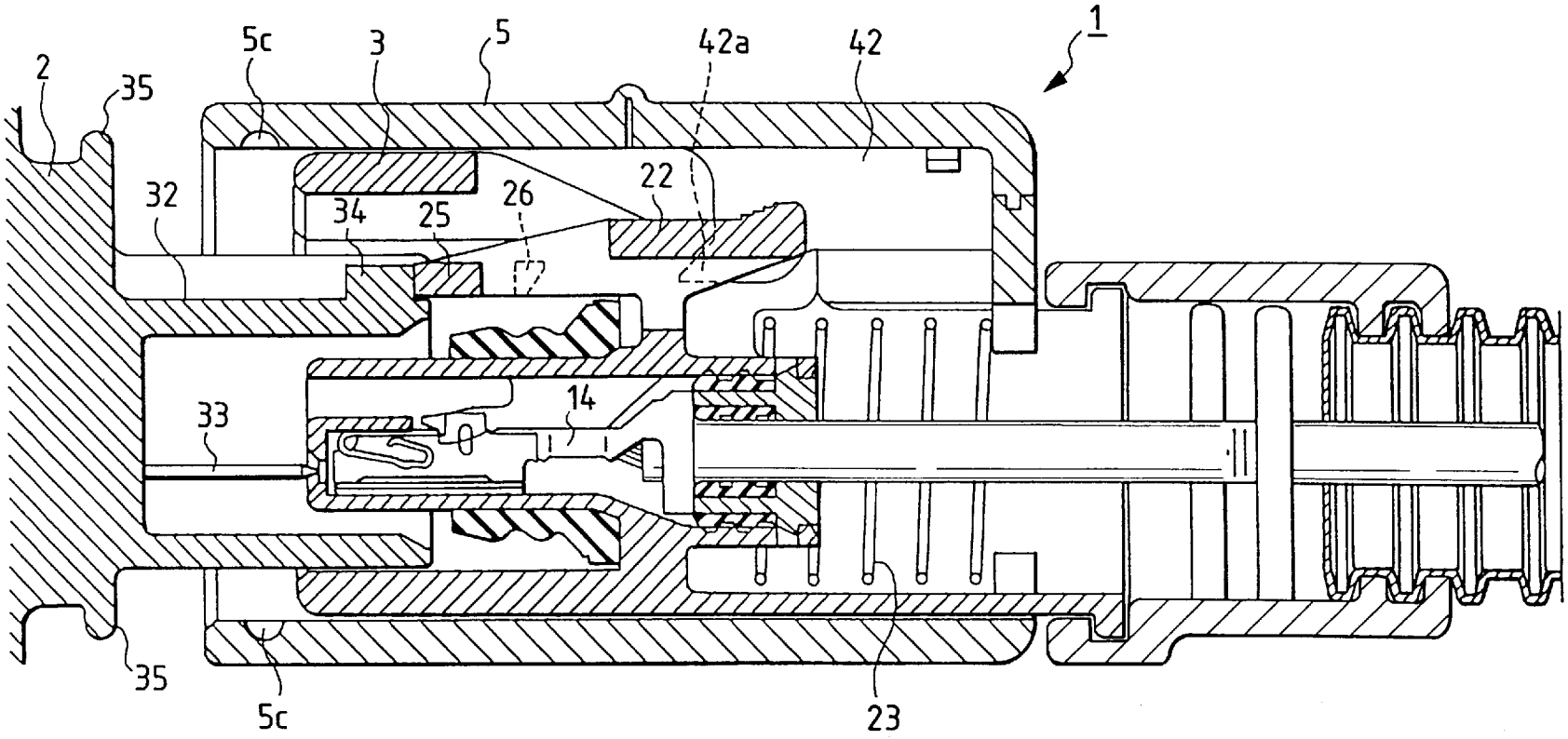
FIG. 5 is a cross-sectional view showing a condition in which a lock member is abutted against a retaining projection during the fitting of the half-fitting prevention connector.
Figure 6:
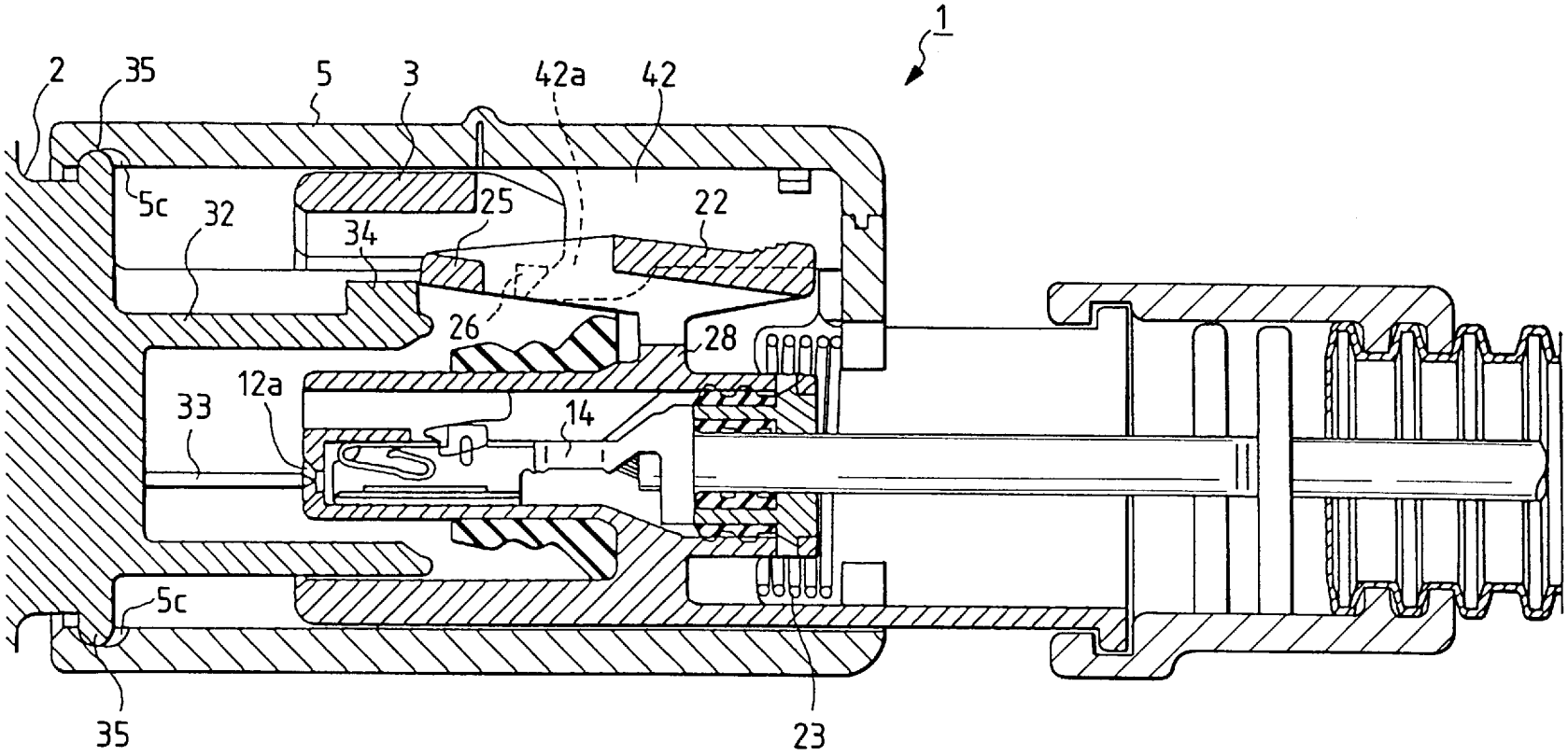
FIG. 6 a cross-sectional view showing a condition in which the lock member of FIG. 5 is pivotally moved.
Figure 7:
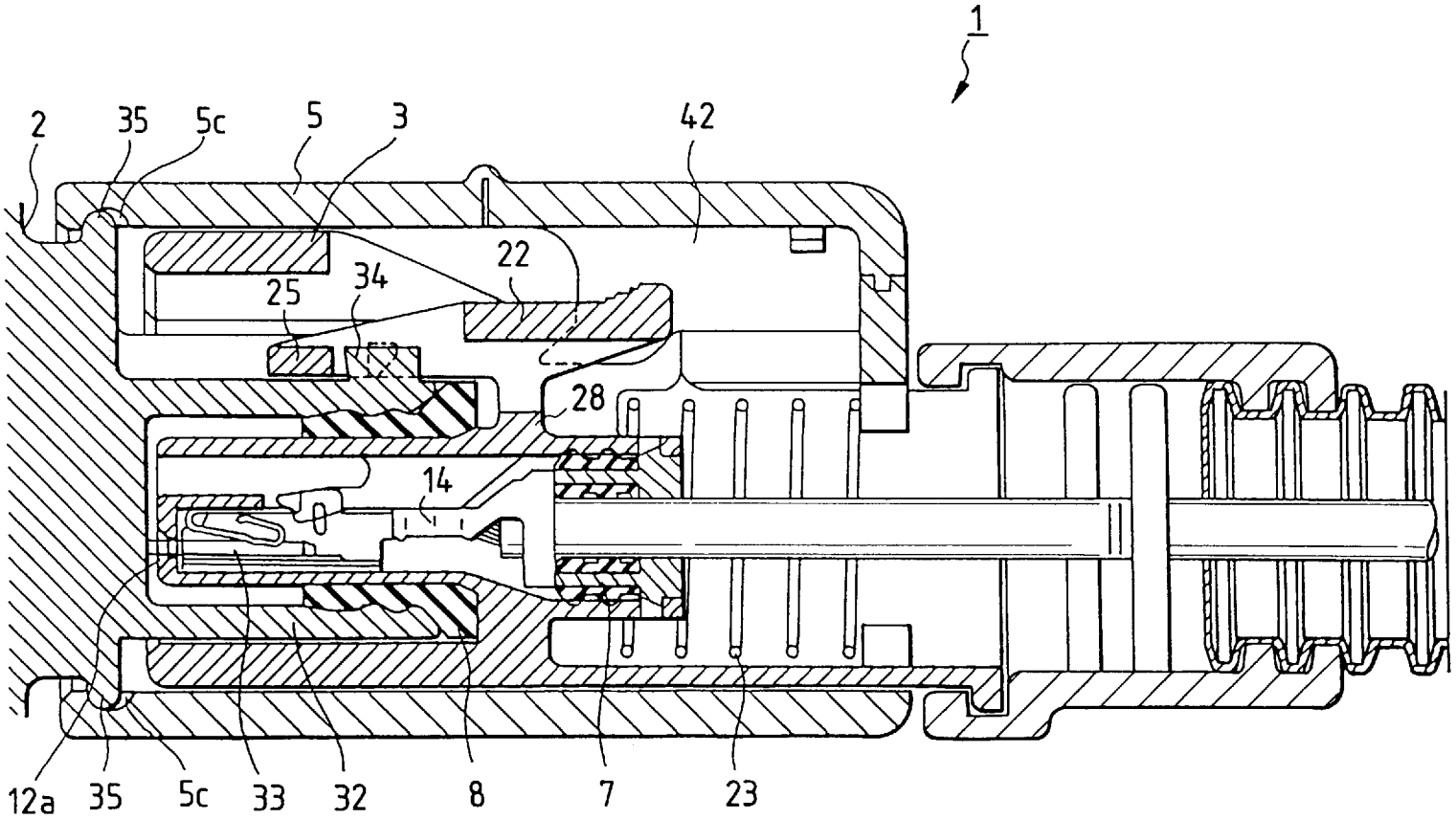
FIG. 7 is a cross-sectional view showing a condition in which a retaining portion of the lock member of FIG. 6 slides over the retaining projection.
Figure 8:
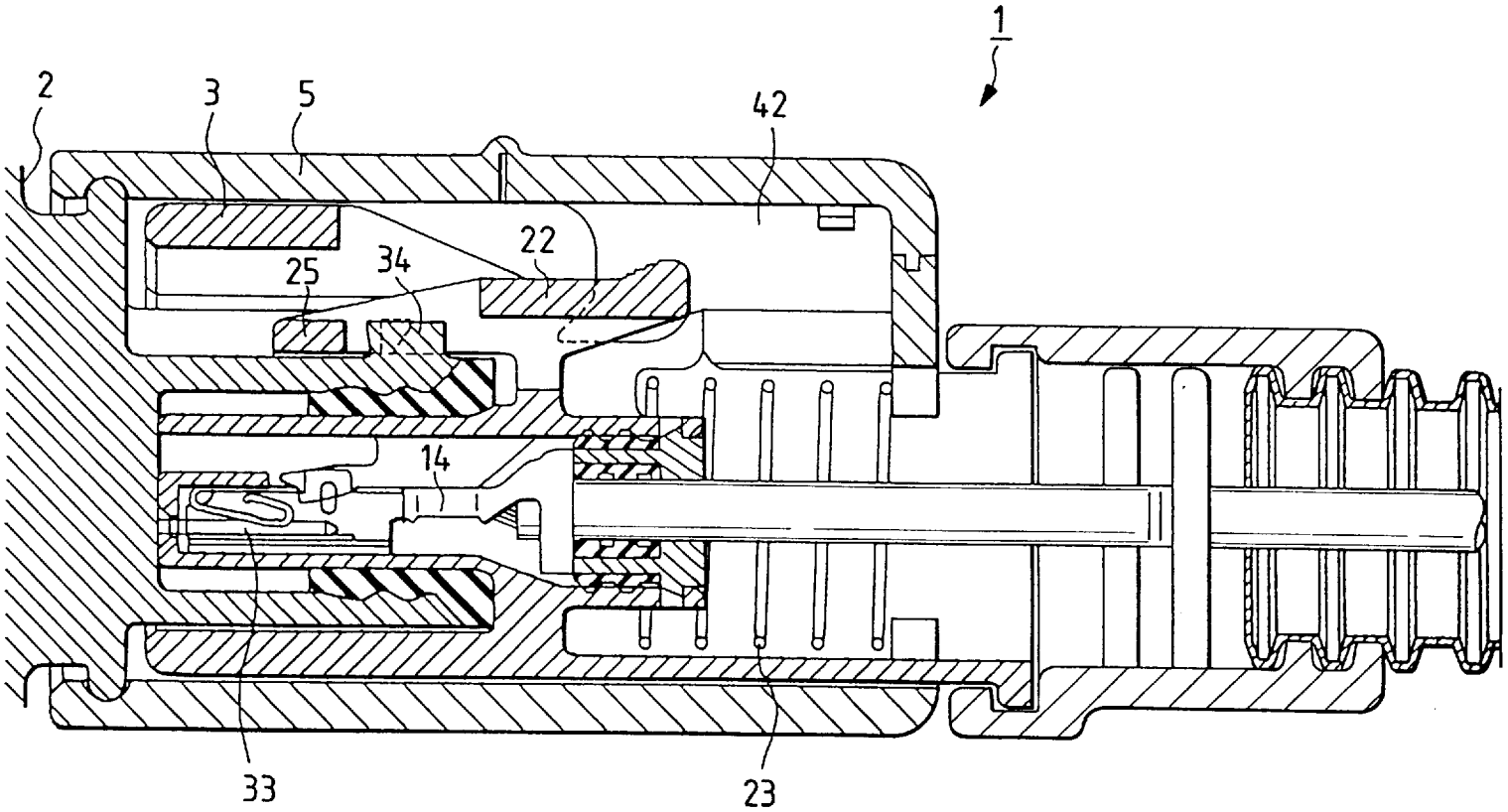
FIG. 8 is a cross-sectional view showing a completely-fitted condition of the connector of FIG. 7.
Figure 9:
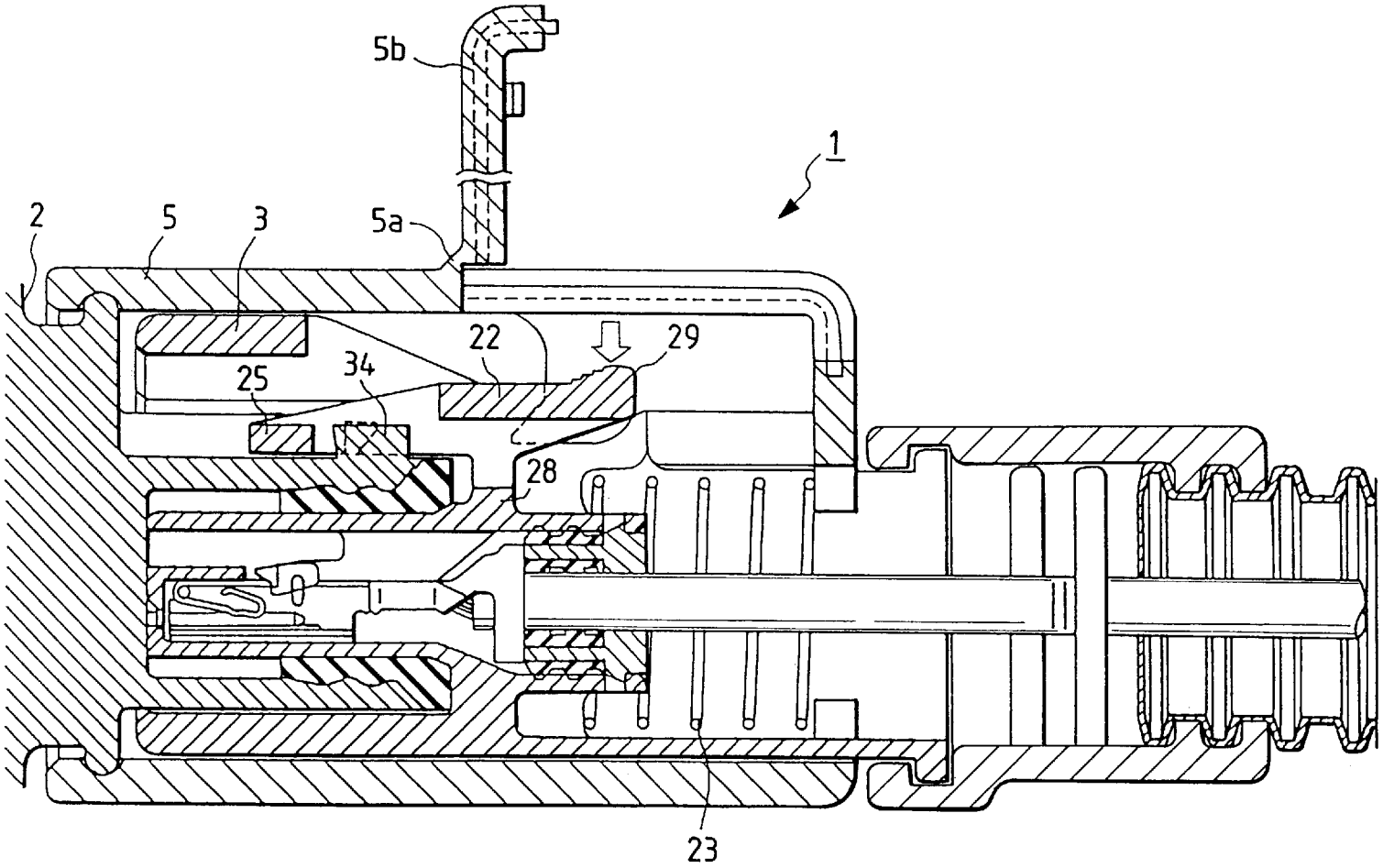
FIG. 9 is a cross-sectional view showing the manner of releasing the fitting of the connector of FIG. 8.
Figure 10:
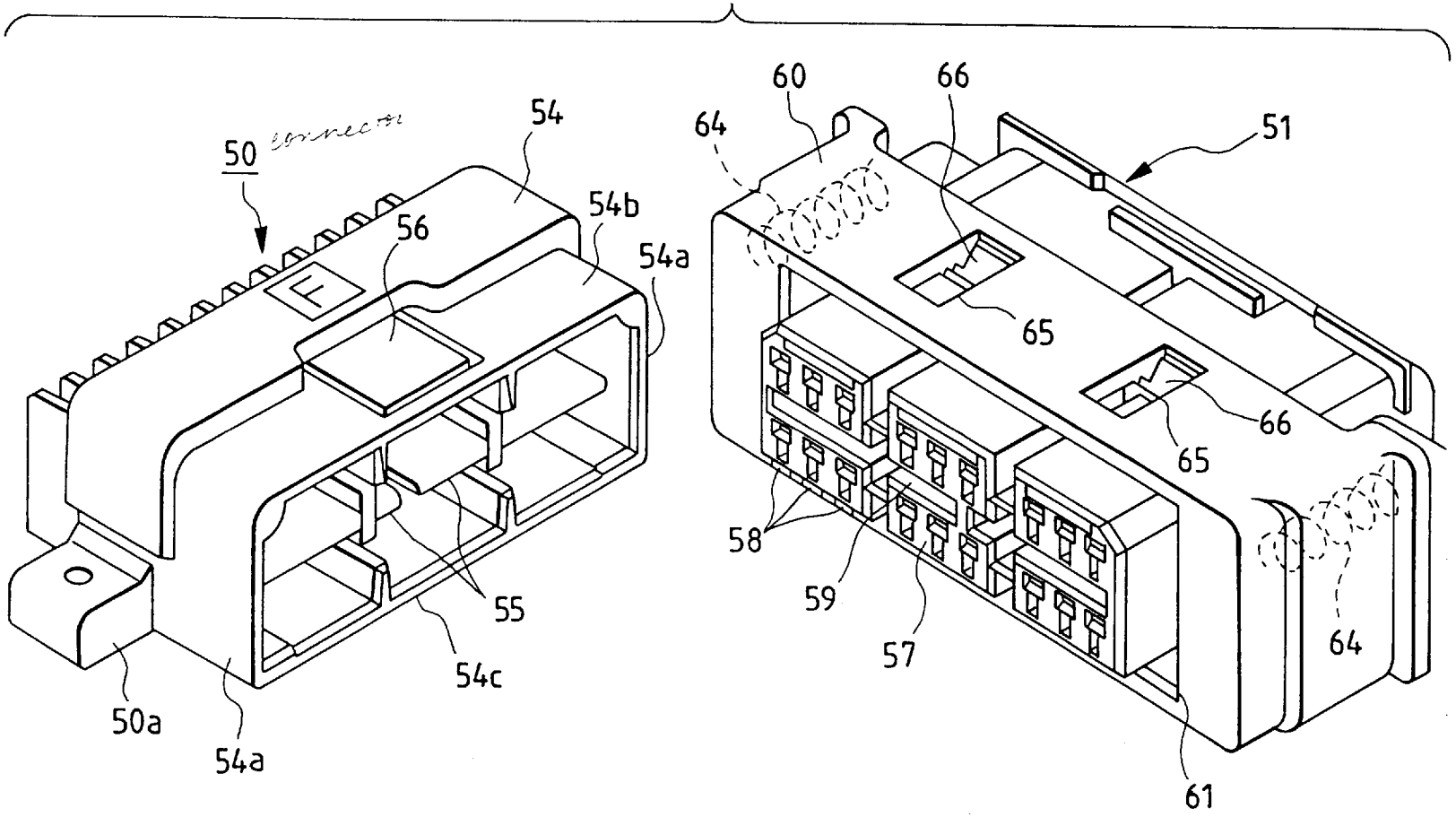
FIG. 10 PRIOR ART
FIG. 10 is a perspective view of a conventional connector.
Figure 11:
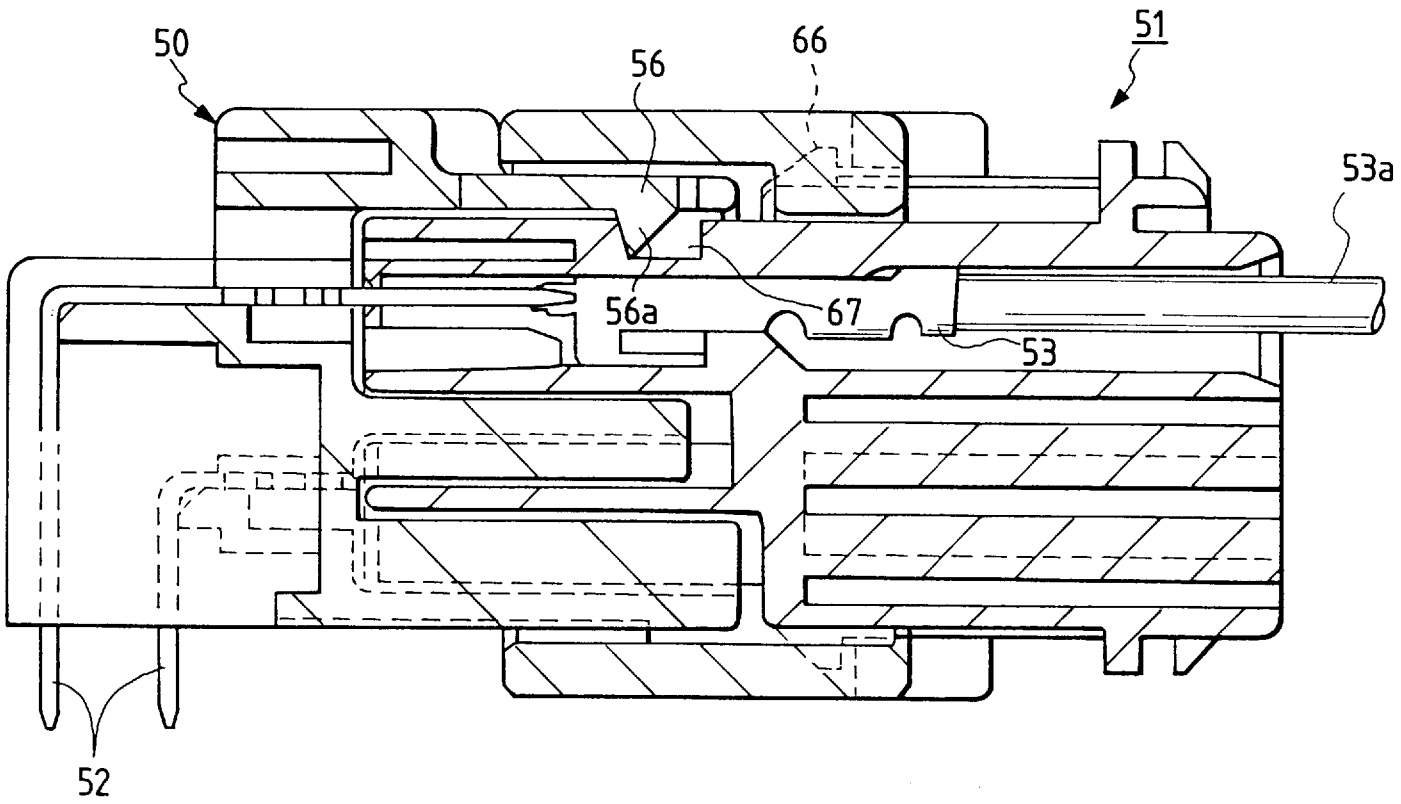
FIG. 11 PRIOR ART
FIG. 11 a vertical cross-sectional view, showing the fitting of the conventional connector.

A preferred embodiment of a half-fitting prevention connector (hereinafter referred to merely as "connector") of the present invention will now be described with reference to FIGS. 1 to 9. FIG. 1 is a vertical cross-sectional view showing the construction of a female connector according to the present invention, FIG. 2 is a horizontal cross-sectional view showing the construction of the connector of FIG. 1, FIG. 3 is a front-elevational view showing the construction of the connector of FIG. 1, FIG. 4(*a*) is a vertical cross-sectional view showing the construction of a mating connector, FIG. 4(*b*) is a front-elevational view of the mating connector, FIG. 5 is a cross-sectional view showing a condition in which a lock member is abutted against a retaining projection, FIG. 6 is a cross-sectional view showing a condition in which the lock member is pivotally moved, FIG. 7 is a cross-sectional view showing a condition in which a retaining portion of the lock member slides over the retaining projection, FIG. 8 is a cross-sectional view showing a completely-fitted condition of the connector, and FIG. 9 is a cross-sectional view showing the manner of a release operation.

With respect to the explanation of this embodiment, the construction of the connectors will first be described with reference to FIGS. 1 to 4, and then the fitting of the connector relative to the mating connection, as well as the release of the fitting of the connector, will be described with reference to FIGS. 5 to 9.

As shown in FIG. 1, the connector 1 of this embodiment is of the female type, and is of such a construction that the connector 1 is prevented from being half fitted (or incompletely fitted) relative to the mating connector of the male type. Specifically, the connector 1 broadly comprises a housing 3 of an integral construction molded of a synthetic resin, and a cover 5 covering the housing 3 over an entire periphery thereof except a fitting side of the housing 3, the cover 5 being made of a soft or flexible resin such as elastomer.

Terminal receiving chambers 13 are formed in a lower portion of a partition wall 4 within the housing 3, and are separated from each other by a partition wall 12. Female connection terminals 14 (for receiving connection terminals of the mating connector, respectively) each clamped and connected to an end portion of a wire 6 are received respectively in the terminal receiving chambers 13. A front end of the connection terminal 14 communicates with an insertion hole 12*a* through which the connection terminal of the mating connector is inserted.

A waterproof packing 8 is fitted on the partition wall 4 in which the connection terminals 14 are fitted, and when the mating connector is fitted in the connector 1, one end portion of a housing of the mating connector is pressed against the waterproof packing 8, thereby preventing the intrusion of water. A waterproof rubber plug 7, comprising a rubber material and a synthetic resin material combined therewith, is also fitted on the wire 6 connected to the rear end portion of the connection terminal 14. The rubber plug 7 prevents the intrusion of water flowing along the surface of the wire 6. A corrugated tube 46 is connected to the rear end of the housing 3 through a rear cover 45.

A lock arm 22, serving as a lock member when fitting the connectors together, is formed integrally on the partition wall 4, and is pivotally movable. A spring (resilient member) 23 is provided rearwardly of the partition wall 4, and the wires 6 pass through this spring 23.

The lock arm 22 is formed on the partition wall 4, and includes a support portion 28 serving as a fulcrum for the pivotal movement of the lock arm 22, a retaining portion 25 formed at its front end for retaining engagement with the mating connector, lock release projections 26 formed respectively on opposite sides of the lock arm 22, and a press portion 29 formed at its rear end for being pressed when releasing a locked condition.

As shown in FIGS. 1 to 3, the cover 5 is slidably fitted on the housing 3 to cover over the entire periphery of the housing except the fitting side of the housing 3. The cover 5 has a fitting release door 5*b* which can be opened and closed through a hinge 5*a*, and cover lock release ribs 42 are formed on an inner surface of the cover 5. The cover lock release ribs 42 abut respectively against the lock release projections 26 during the fitting of the connector 1 on the mating connector 2. Formed at a front end of the cover lock release rib 42 is a release portion 42*a* for pushing the associated lock release projection 26 upward when the connector 1 is fitted in the mating connector, the release portion 42*a* having a forwardly-slanting surface.

A pair of retaining grooves 5*c* for retaining the mating connector are formed in the inner surface of the cover 5 at the front end portion thereof in opposed relation to each other.

Next, the construction of the mating connector will be described. As shown in FIG. 4, the mating connector 2 is of the male type. The mating connector 2 includes a tubular insertion frame 32 projecting in the fitting direction, and male terminals 33 inserted in the insertion frame 32, are retained therein. A retaining projection 34 for retaining engagement with the retaining portion 25 of the lock arm 22 is formed on an upper surface of the insertion frame 32. A pair of oppositely-facing, retaining ribs 35 for retaining engagement respectively in the retaining grooves 5*c* in the cover 5 are formed respectively on upper and lower surfaces of a connector body adjacent to a proximal end of the insertion frame 32. Therefore, when the two connectors are fitted together, the partition wall 12 is inserted into the insertion frame 32, with the waterproof packing 8 held in sliding contact with the insertion frame 32.

The operation of the engagement of the connector 1 and the mating connector 2 will now be described with reference to FIGS. 5 to 8. For fitting the connector 1 and the mating connector 2 together as shown in FIG. 5, the cover 5, slidably fitted over the entire housing 3, is held with the hand, and the connector 1 is pushed onto the mating connector 2 so that the insertion frame 32 of the mating connector 2 is inserted into the housing 3. As a result, the retaining portion 25, formed at the front end of the lock arm 22, abuts against the retaining projection 34 formed on the insertion frame 32 of the mating connector 2, so that the fitting operation is once stopped.

Then, when the connector 1 is further pushed as shown in FIG. 6, only the cover 5, which is slidable relative to the housing 3, is moved in the fitting direction against the bias of the spring 23, while compressing the spring 23, so that the release portions 42*a*, formed respectively at the front ends of the cover lock release ribs 42 formed on the inner surface of the cover 5, abut respectively against the lock release projections 26 of the lock arm 22. Then, when the connector 1 is further pushed, the slanting surface of each of the release portions 42*a* pushes the associated lock release projection 26 upward, so that the front portion of the lock arm 22 is pivotally moved upward about the support portion 28, and the retaining grooves 5*c* and 5*c*, formed in the front end portion of the cover 5, are retainingly fitted respectively on the retaining ribs 35 and 35 on the mating connector 2. As a result, the retaining portion 25, abutted against the retaining projection 34, is pivotally moved upward, and slides over the retaining projection 34.

At this time, the housing 3 is vigorously moved in the fitting direction by the bias or resiliency of the spring 23, and therefore the retaining portion 25 of the lock arm 22 is retained by the retaining projection 34 on the mating connector 2, and also the male terminals 33, mounted on the mating connector 2, are inserted respectively into the female terminals 14 through the respective insertion holes 12*a*, as shown in FIG. 7. Then, by further pushing the cover 5, the male terminals 33 are completely connected to the female terminals 14, respectively, and the connector 1 and the mating connector 2 are completely fitted together, thus completing the connector fitting operation, as shown in FIG. 8.

In the condition shown in FIG. 6, the connector 1 of this embodiment is in a half-fitted condition relative to the mating connector 2, and the rear end portion of the housing 3 is clearly projected from the rear end of the cover 5, and from this, the half-fitted condition (that is, an incompletely-fitted condition) can be easily detected during the fitting of the connector 1 on the mating connector 2.

For releasing the fitting between the two connectors, the fitting release door 5*b*, provided at the rear portion of the cover 5, covering the housing 3, is opened, and the press portion 29 is pressed by the finger or the like in a direction of an arrow in FIG. 9. As a result, the lock arm 22 is forcibly moved pivotally in a clockwise direction about the support portion 28, so that the lock arm 22 is easily brought out of retaining engagement with the retaining projection 34 on the mating connector 2, and the connector 1 can be disconnected from the mating connector 2.

As described above, when fitting the connector 1 of this embodiment relative to the mating connector 2, with the cover 5 (slidably fitted on the housing 3 over the entire periphery thereof) held with the hand, the retaining portion 25 at the front end of the lock arm 22 is brought into abutment against the retaining projection 34 on the insertion frame 32, and thereafter the slidable cover 5 is moved in the fitting direction against the bias or resiliency of the spring 23, so that the release portions 42*a* of the cover lock release ribs 42 push the lock release projections. 26 of the lock arm 22 upward, respectively. As a result, the retaining portion 25 of the lock arm 22 slides over the retaining projection 34, and then the whole of the housing 3 is moved in the fitting direction by the resiliency of the spring 23, so that the retaining portion 25 is retained by the retaining projection 34, thus completing the operation of fitting of the connector 1 on the mating connector 2.

Therefore, if the fitting operation is stopped before the retaining portion 25 slides over the retaining projection 34, the cover 5 is urged or returned in an anti-fitting direction by the bias or resiliency of the spring 23, so that the cover 5 is disengaged, or the rear end portion of the housing 3 is projected from the rear end of the cover 5. Thus, the half-fitted condition can be easily detected by the operator. Therefore, engaging the connector 1 to the mating connector 2 can be performed positively and easily, and the efficiency of the operation can be enhanced, because the half-fitted condition can be easily prevented from.

Since the entire the housing 3, except its fitting side, is covered with the cover 5, the housing 3 is protected from any external forces, and therefore an accident, such as the disengagement of the housing during use, is prevented. In addition the waterproof effect of the housing 3 is improves. This greatly enhances the reliability of a device in an automobile, such as electronic device in which the connector 1 is used, and simplifies the maintenance.

Furthermore, the connector of this embodiment has various other advantages over the conventional connectors of this type. For example, the number of the component parts is smaller, and the assembling operation is easier.

As described above, in the half-fitting prevention connector of the present invention, the housing has the lock member for retaining engagement with the retaining projection formed on the mating connector, and the lock member is pivotally moved in accordance with the fitting of the connector relative to the mating connector, and has the lock release projections formed respectively on the opposite sides of the lock member, and the cover member is slidably fitted on the housing, and covers the housing over the entire periphery thereof, and the cover member has the cover lock release ribs formed on the inner surface thereof, and the cover lock release ribs abut respectively against the lock release projections in accordance with the fitting of the connector relative to the mating connector.

When fitting the half-fitting prevention connector of the above construction relative to the mating connector, with the cover member (slidably fitted on the housing over the entire periphery thereof) held with the hand, the retaining portion at the front end of the lock member on the housing is brought into abutment against the retaining projection on the mating connector, and thereafter the cover member is moved toward the mating connector against the bias or resiliency of the resilient member, so that the cover lock release ribs push the lock release projections upward, respectively, to pivotally move the front portion of the lock member. As a result, the lock member slides over the retaining projection of the mating connector, and then the whole of the housing is moved toward the mating connector by the resiliency of the resilient member, so that the lock member is retained by the retaining projection, thus completing the operation of fitting of the connector on the mating connector.

Therefore, if the fitting operation is stopped before the retaining portion slides over the retaining projection, the cover member is urged or returned in the anti-fitting direction by the bias or resiliency of the resilient member, so that the cover member is disengaged, or the rear end portion of the housing is projected from the rear end of the cover member. From this, the half-fitted condition can be easily detected. Therefore, the operation of fitting of the connector relative to the mating connector can be effected positively and easily, and the efficiency of the operation can be enhanced, and the half-fitted condition can be positively prevented from being maintained.

Since the whole of the housing except its fitting side is covered with the cover member, the housing can be positively protected from an external force, and therefore an accident, such as the disengagement of the housing during use, is prevented, and the waterproof effect of the housing is enhanced. This greatly enhances the reliability of a device in an automobile, an electronic device and so on in which the connector is used, and besides the maintenance is easy.

For releasing the fitted condition, the fitting release door, provided on the cover member covering the housing, is opened, and then the lock member is pressed to be pivotally moved, so that the lock member can be easily brought out of retaining engagement with the retaining projection of the mating connector. The efficiency of the operation, including the maintenance, can be enhanced.

What is claimed is:

1. A half-fitting prevention connector comprising:

a housing having an electrical terminal therein;

a resilient member mounted on said housing;

a lock member disposed in said housing for retaining engagement with a retaining projection disposed on a mating connector, said lock member pivoting as said mating connector is inserted into said housing in an insertion direction, said lock member having lock release projections formed respectively on opposite sides thereof; and a cover member slidably fitted on said housing and covering said housing over an entire periphery thereof, said cover member having cover lock release ribs formed on an inner surface thereof for abutting against said lock release projections which pivotally move said lock member as said cover member slides in the insertion direction of said mating connector during insertion of said mating connector into said housing, wherein said resilient member urges said cover member in a direction opposite to the insertion direction of said mating connector.

2. A half-fitting prevention connector according to claim 1, further comprising a partition wall disposed in said housing and for receiving connection terminals, wherein said lock member is disposed through a support portion on said partition wall pivotally movable about said support portion and integrally with said partition wall, and wherein said lock member has at its front end a retaining portion for retaining engagement with the retaining projection, and has at its rear end a press portion which is pressed when releasing a locked condition.

3. A half-fitting prevention connector according to claim 1, wherein said cover member includes a fitting release door mounted thereon through a hinge portion for being opened and closed, and a retaining groove for retaining engagement with a retaining rib disposed on the mating connector, said retaining groove being disposed on an inner surface of said cover member at a front end portion thereof.

4. A half-fitting prevention connector according to claim 1, further comprising a release portion disposed at a front end of each of said cover lock release ribs, said release portion having a forwardly-slanting surface, and pushing the associated lock release projection upward with the fitting of the mating connector.

5. A half-fitting prevention connector according to claim 1, wherein said resilient member is a spring, said cover being displaceable toward said mating connector to compress said spring.

6. A half-fitting prevention connector according to claim 1, wherein said cover surrounds the front end of said lock member so that said cover protects the front end of said lock member when said cover slides relative to said housing.

7. A half-fitting prevention connector according to claim 2, wherein a middle portion of said lock member is disposed on said support partition, so that said support partition functions as a fulcrum during a pivotal movement of said lock member.

* * * * *